United States Patent [19]

Niskin

[11] 4,350,931

[45] Sep. 21, 1982

[54] LIGHT SAVER DEVICE

[76] Inventor: Shale J. Niskin, 3415 Chase Ave., Miami Beach, Fla. 33140

[21] Appl. No.: 223,397

[22] Filed: Jan. 8, 1981

[51] Int. Cl.[3] ..... H01J 7/44; H05B 37/00

[52] U.S. Cl. ..... 315/72; 315/200 R

[58] Field of Search ..... 315/72, 200 R, 71

[56] References Cited

U.S. PATENT DOCUMENTS

| | | | |
|---|---|---|---|
| 3,062,986 | 11/1962 | Fritz et al. | 315/200 R |
| 3,450,893 | 6/1969 | Munson | 315/200 R |
| 3,823,339 | 7/1974 | Borneman et al. | 315/200 R |
| 3,963,956 | 6/1976 | Beining | 315/200 R |

*Primary Examiner*—Harold A. Dixon

*Attorney, Agent, or Firm*—William A. Newton

[57] ABSTRACT

Disclosed is a light saver device to be used in combination with a bayonet-type lamp and socket, wherein the light saver device comprises a pair of circular plate contacts having a diode mounted therebetween, three plastic insulating sheets being bonded together with the elongated plate contacts positioned between the sheets, an adhesive tape base mounted to the outer side of one of the sheets, and one of the sheets having a pair of tabs for securing the light saver device to a pair of pins extending from the lamp.

5 Claims, 3 Drawing Figures

LIGHT SAVER DEVICE

FIELD OF THE INVENTION

The present invention relates to energy saving devices for reducing power consumption by electric light bulbs or lamps.

DESCRIPTION OF THE PRIOR ART

Diode devices have been implanted between the bottom contact of a screw-in lamp and the threaded socket. However, this arrangement has two distinct disadvantages. First, these diode arrangements are not adaptable to a bayonet-type lamp. Second, the diode is squeezed between the contact of the lamp and the base of the socket, frequently resulting in the diode being crushed and made inoperable.

Accordingly, it can be seen that there is a need in the industry to have a diode device capable of being adapted to a bayonet-type lamp and in which the diode is protected when the lamp is inserted into its receiving socket.

SUMMARY OF THE INVENTION

The present invention involves a light saver device constructed so as to be usable in a bayonet lamp and socket arrangement. The light saver device comprises a pair of circular plate contacts having a diode securely mounted therebetween so as to electrically couple the elongated plate contacts. Three insulating sheets formed of plastic are utilized, with one sheet going between the two plate contacts and the other two sheets going on the outer sides of the two plate contacts. The three insulating sheets are subjected to heat so as to bond the plastic sheets together, with the two plate contacts being immovably encased between adjacent layers of the insulating sheets. A hole passes entirely through the three sheets for one of the contacts of the lamp to electrically engage one of the spring loaded bar contacts of the socket. A hole is formed in each of the outer sheets over the adjacent plate contact so that one of the plate contacts engage the other lamp contact and the other plate contact engages the other bar contact of the socket. One of the sheets is provided with a pair of tabs with holes formed therein. This tab arrangement allows for the light saver device to be secured to pins protruding from the lamp.

By virtue of the above described structure, the diode rectifies the AC current provided from the socket so as to reduce the power consumption of the lamp. The reduced power consumption in turn reduces the heat which extends the life of the lamp. Additionally, the bar contacts of the socket are spring biased, which prevents the diode from being broken.

BRIEF DESCRIPTION OF THE DRAWINGS

Further objects and advantages of the present invention will become apparent as the following description proceeds, taken in conjunction with the accompanying drawings in which.

DESCRIPTION OF THE PREFERRED EMBODIMENT

Figure 1:
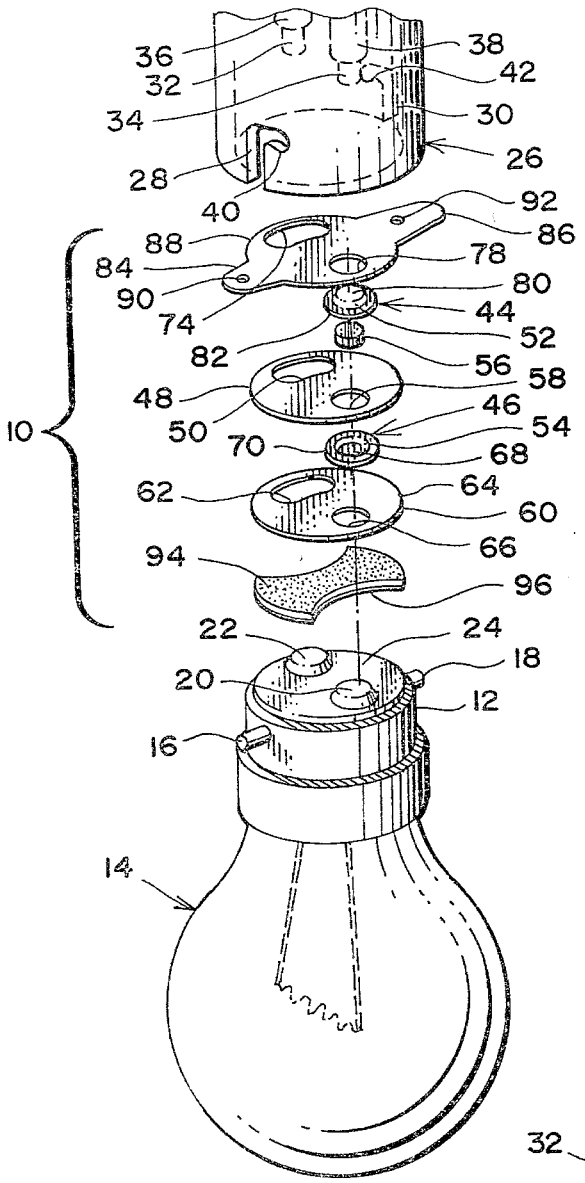
FIG. 1 is an exploded view of the light saver device with the bayonet socket and lamp arrangement being spaced apart from the exploded light saver device.

Disclosed is a light saver device, generally indicated as 10, which is designed and constructed to be attached snugly and non-rotatably to a base 12 of a bayonet-type lamp 14. The bayonet-type lamp 14 is of a common and well-known design wherein the base 12 of the lamp has a pair of protruding, opposed pins 16 and 18. A pair of electrical contacts 20 and 22 are mounted on an insulated end 24 of the base 12. As is well-known these contacts 20 and 22 are coupled to the filament inside the lamp 14. The base 12 of the lamp 14 is configured and dimensioned to slide into a well-known socket 26, which has a pair of L-shaped slots 28 and 30. The socket 26 has a pair of spring loaded bar contacts 32 and 34. In its prior art usage, when the lamp 14 is inserted into the interior of the socket 26, the pins 16 and 18 slide up into the L-shaped slots 28 and 30. At the same time the contacts 20 and 22 engage the bar contacts 32 and 34 so that the bar contacts are pushed inward into their mounting sleeves 36 and 38 respectively. The contacts 20 and 22 have an elongated configuration so as to continue the electrical contact and engagement between the contacts 20 and 22 and the bar contacts 32 and 34 while the lamp is being rotated clockwise about its longitudinal axis so that the pins are secured in the enlarged ends 40 and 42 of the L-shaped slots 28 and 30. The spring biasing of the bar contacts 32 and 34 maintained the pins 16 and 18 in the enlarged ends 40 and 42. The socket 26 and the lamp 14 have been described in detail herein to show the environment in which the light saver device 10, which will be described hereinafter, is to be used. The socket 26 and the lamp 14 are of conventional design and are in very common use.

Figure 2:
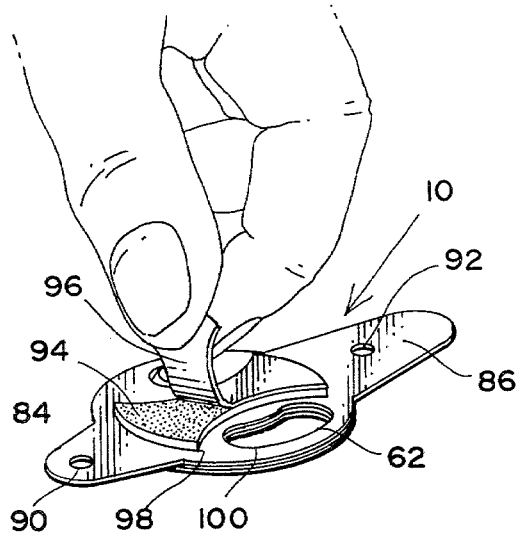
FIG. 2 shows the assembled light saver device with the paper being removed from its tape base so as to expose an adhesive surface.

FIG. 2 illustrates the light saver device 10 in its assembled configuration, while FIG. 1 shows the light saver device 10 in an exploded illustration to show the individual components. A pair of relatively flat, circular, plate contacts 44 and 46 are mounted on opposed sides of a plastic insulating sheet 48. The insulating sheet 48 has an elongated hole 50 formed therein which is dimensioned and configured to allow one of the protruding contacts 20 or 22 to extend therethrough. A pair of pockets 52 and 54 are formed in the contacts 44 and 46 respectively so as to securely mount a diode 56 between the contacts 44 and 46. A hole 58 is formed in the insulating sheet 48 to allow the diode to pass therethrough. The insulating sheet 48 has a circular configuration. A second plastic insulating sheet 60 is secured to the other side of the plate contact 46 by securing the insulating sheet 60 to the insulating sheet 48. This securement is accomplished by applying heat to the plastic sheets 48 and 60, which results in them sufficiently melting to form a bond in a well known manner. The insulating sheet 60 has an elongated hole 62 aligned with the elongated hole 50 so as to allow one of the protruding contacts 20 or 22 to pass therethrough. The second insulating sheet 60 has a hole 66 which is aligned with the plate contact 46 so that an enlargement 68 formed by the pocket 54 extends through the hole 66. A third insulating sheet 72 is secured over the outer side of the plate contact 44 by securing the same to the first insulating sheet 48. Again, the method of securement comprises applying heat to the sheets 48 and 72 so as to sufficiently melt the same and form a bond therebetween. The third sheet 72 has an elongated hole aligned with the elongated holes 50 and 62 so as to allow one of the protruding contacts 20 and 22 to pass therethrough. As with the second sheet 60, the third sheet 72 has a hole 78, to allow an enlargement 80, formed by the pocket 52, to extend therethrough. A pair of opposed tabs 84 and 86 are integrally formed on either side of a circular center portion 88 of the third sheet 72. A pair of small apertures 90 and 92 are formed in the tabs. A resilient base 94, with expanding ends, is provided with adhesive opposed surfaces. The adhesive surface on one side allows the base 94 to be secured to the second sheet 60. A paper covering 96 is normally mounted over the other adhesive side prior to utilizing the light saver device 10.

Figure 3:
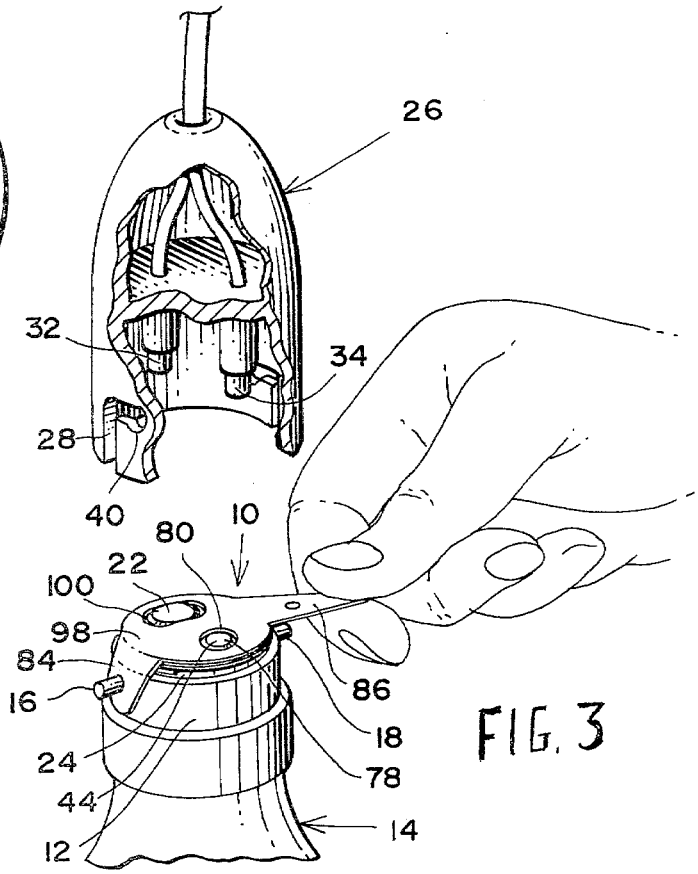
FIG. 3 shows the assembled light saver device being mounted over the pins of the lamp, with the socket being positioned overhead in a partially fragmentary view.

As can be seen in FIGS. 2 and 3, the center portion 88 of the third sheet 72, the second sheet 60, and the first sheet 48 form a circular, center body portion 98 of the light saver device 10. The three enlongated holes 50, 62, and 74 form a single cutout 100. The two plate contacts 46 and 48 are embedded in between the sheets so as to be insulated from each other, except through the diode 56.

In operation, the covering 96 is peeled off of the base 94, as shown in FIG. 2. As shown in FIG. 3 the short tab 84 is positioned over the pin 16 so that the pin protrudes through the hole 90. The center body portion 98 is then positioned over the end 24 so that the contact 22 protrudes through the cutout 100. Then the long tab 86 is positioned over the pin 18 so that the same protrudes through the aperture 92. The base 94 is maintained in a nonmovable relationship to the lamp 14 by the adhesive bond generated by the double adhesive tape base 94. The protruding contact 20 is in electrical contact with the enlargement 68 of the plate contact 46 through the hole 66. Next, the lamp 14, with the light saver device 10 secured thereto, is inserted into the socket 26 and locked into position in the conventional manner heretofore described. The bar contact 34 engages the contact 22 and the bar contact 32 engages the enlargement 80 of the plate contact 44 through the hole 78.

In summary, the protruding contact 22 engages the bar contact 34 by passing through the cutout 100. The protruding contact 20 is in electrical contact with the plate contact 46, which in turn is electrically coupled to the plate contact 44 through the diode 86. The bar contact 32 is electrically in contact with the plate contact 44 to complete the circuit between the contacts 32 and 20.

The diode is designed to be a rectifier which passes only one polarity of an AC current applied to the bar contacts 32 and 34 through a conductor 102 which is coupled to a power supply (not shown). The attached light saving device 10 in no way changes the normal position of the lamp 14 in the socket 26, nor is the user required to fit the lamp 14 to its socket 26 in any unusual way. As a result, half of the power consumption of the lamp is eliminated, which in turn results in sufficient decrease in heat that the life of the lamp is substantially extended.

The second sheet 60 and the third sheet 72 are formed from a 10 millimeter thick Mylar plastic. The third sheet 72 is formed from a clear, single sealed Mylar plastic which is 2 millimeters thick. Mylar is a trademark of DuPont. The plate contacts 40 and 46 are both formed from tin plated copper which is 10 millimeters thick. The diode 56 is identified as S3A4C0 and has a 3 amp maximum and a 400 volt maximum. The tape base 94 comprises a commercially available double sealed Neoprene foam No. 4265. These components are described here merely to illustrate commercial components presently available on the market.

Although particular embodiments of the invention have been shown and described here, there is no intention to thereby limit the invention to the details of such embodiments. On the contrary, the intention is to cover all modifications, alternatives, embodiments, usages and equivalents of the subject invention as fall within the spirit and scope of the invention, specification and the appended claims.

What is claimed is:

1. A light saving device for use with a bayonet-type lamp and electrical socket, said light saving device comprising:

first and second plate contacts;

a diode positioned between and being held by holding portions of said plate contacts to electrically couple together said plate contacts when said diode is in its conductive state;

three sheets of plastic insulating material, a first sheet, a second sheet, and a third sheet, being positioned on top of each other and being heat bonded to each other, with said first sheet being in the middle;

said first plate contact being immovable encased between said first sheet and said second sheet, said second plate contact being immovably encased between said first sheet and said third sheet;

at least one of said sheets having a pair of opposed tabs integrally formed therein, each tab having an aperture formed therein;

said second and third sheets each having a contact-receiving hole formed therein which is positioned to expose a portion of the adjacent said plate contact, said exposed portions of said plate contacts being spaced apart from said holding portions of said plate contacts, whereby said diode will be protected when said light saving device is in use;

each of said three sheets having an aligned hole formed therein, said three aligned holes being arranged to form a single cutout passing through said three sheets, said cutout being in spaced-apart relationship to said plate contacts.

2. The light saving device of claim 1, wherein said plate contacts have a pair of enlargements, each of which define a pocket, said pockets being arranged to face each other and to securely hold said diode.

3. The light saving device of claim 2, wherein each of said contact-receiving holes are aligned to each receive one of said enlargements of said plate contacts.

4. The light saving device of claim 3, further including tape base with adhesive on opposite sides, one of said adhesive sides being used to mount said tape base to one of the outer said sheets between said cutout and said contact-receiving hole.

5. The light saving device according to claim 1 or 3, wherein said bayonet-type lamp has a base with a pair of opposed pins laterally protruding from said base and a pair of protruding, elongated contacts protruding from the end of said base; said socket has a pair of opposed latching slots aligned for receiving said pins and a pair of opposed, spring-loaded bar magnets; said tabs being dimensioned and arranged to have said pins to pass through said apertures of said tabs to secure said light saving device to said bayonet lamp; said cutout being dimensioned and configured to receive one of said elongated contacts so that one of said bar contacts engage said elongated contact; said contact-receiving hole formed in said second sheet being aligned with the other said elongated contact so that the other said elongated contact engages said first plate contact, said contact-receiving hole formed in said third sheet being aligned with the other said bar contact so that the other said bar contact engages said second plate contact.

* * * * *